United States Patent [19]

Liautaud et al.

[11] Patent Number: 4,485,946

[45] Date of Patent: Dec. 4, 1984

[54] BELT HOLDER FOR PORTABLE RADIO APPARATUS

[75] Inventors: James P. Liautaud, River and Bluff Rds., Trout Valley, Cary, Ill. 60013; Peter F. Stultz, Elgin; David L. Maloney, Barrington, both of Ill.

[73] Assignee: James P. Liautaud, Elgin, Ill.

[21] Appl. No.: 529,856

[22] Filed: Sep. 6, 1983

[51] Int. Cl.[3] ..... A45F 5/02

[52] U.S. Cl. ..... 224/242; 224/196; 224/197; 224/252; 455/351

[58] Field of Search ..... 224/914, 904, 185, 195, 224/196, 197, 199, 200, 224, 233, 235, 240, 242, 247, 251, 252, 269, 271, 272, 245, 198; 206/477, 478, 480; 221/185, 210, 217, 219, 273, 272; 222/175, 613, 517, 221, 222, 180, 181; 211/13, 15, 53, 60 R, 70, 89; 248/225.4, 225.3 A, 231.1, 229, 316.3; 455/351

[56] References Cited

U.S. PATENT DOCUMENTS

| | | | |
|---|---|---|---|
| 581,568 | 4/1897 | Wilde | 224/32 R X |
| 1,384,145 | 7/1921 | Monlon | 224/196 |
| 1,764,352 | 6/1930 | Sacerdote | 221/272 X |
| 2,432,561 | 12/1947 | De Mott | 221/273 X |
| 2,560,381 | 7/1951 | Babington | 222/175 X |
| 2,658,650 | 11/1953 | Jasper | 224/242 X |
| 2,708,537 | 5/1955 | Dec | 224/196 |
| 3,212,688 | 10/1965 | Lane | 224/904 X |
| 3,481,458 | 12/1969 | Mayeaux | 248/229 X |
| 3,524,571 | 8/1970 | Young et al. | 224/196 |
| 3,631,994 | 1/1972 | Mackzum, Jr. | 224/252 |
| 3,743,147 | 7/1973 | Wilczynski | 224/199 |
| 3,750,918 | 8/1973 | Jensen | 224/200 |
| 3,878,589 | 4/1975 | Schaefer | 224/272 X |
| 4,046,295 | 9/1977 | Eichler | 224/251 X |
| 4,299,344 | 11/1981 | Yamashita et al. | 224/252 X |

*Primary Examiner*—Stephen Marcus
*Assistant Examiner*—Robert Petrik
*Attorney, Agent, or Firm*—Lockwood, Alex, Fitzgibbon & Cummings

[57] ABSTRACT

A belt holder for portable radio apparatus and the like includes a belt fastener and a receptacle housing. The receptacle housing is pivotally mounted to the belt fastener. A clamp mechanism includes a sliding clamp body having two projecting clamp arms which engage the radio apparatus to prevent the apparatus from falling from the receptacle housing. A cam mechanism, operated with rotation of the receptacle housing with respect to the belt fastener, actuates the clamp mechanism to disengage the radio apparatus from the belt holder.

14 Claims, 11 Drawing Figures

FIG. 4
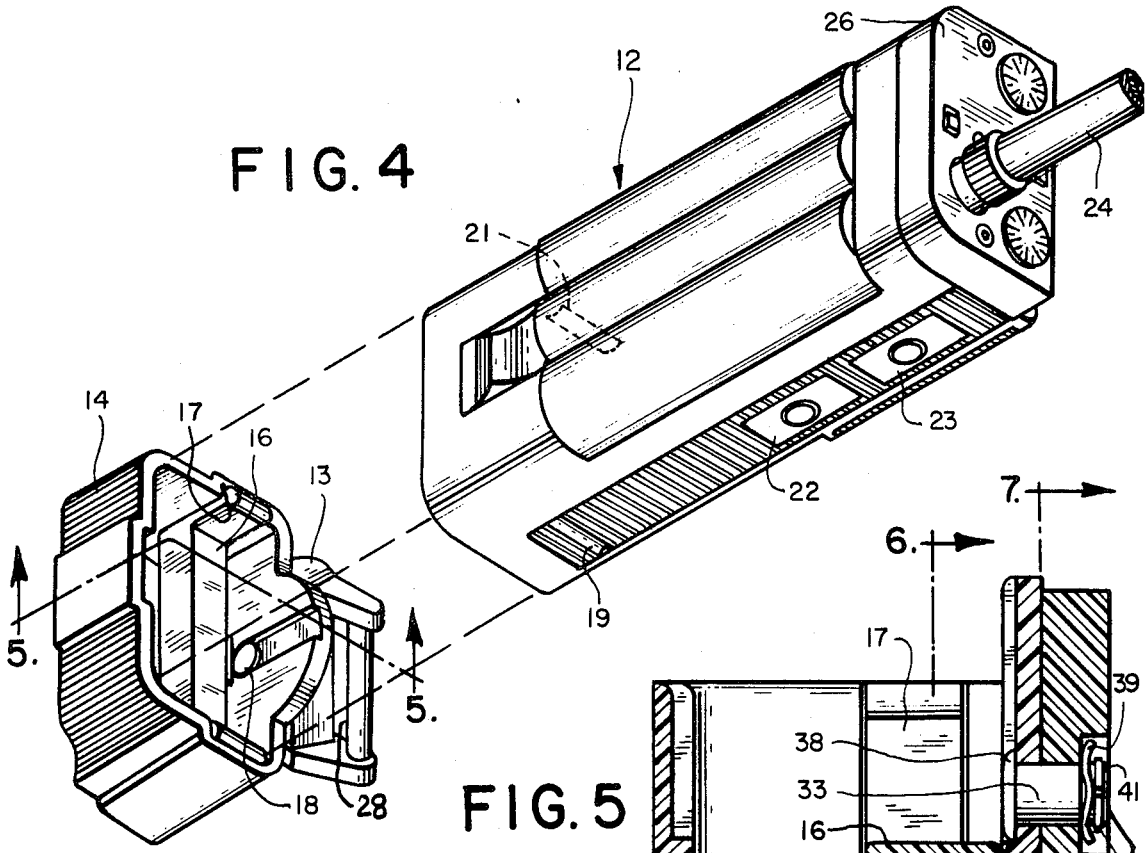
FIG. 5
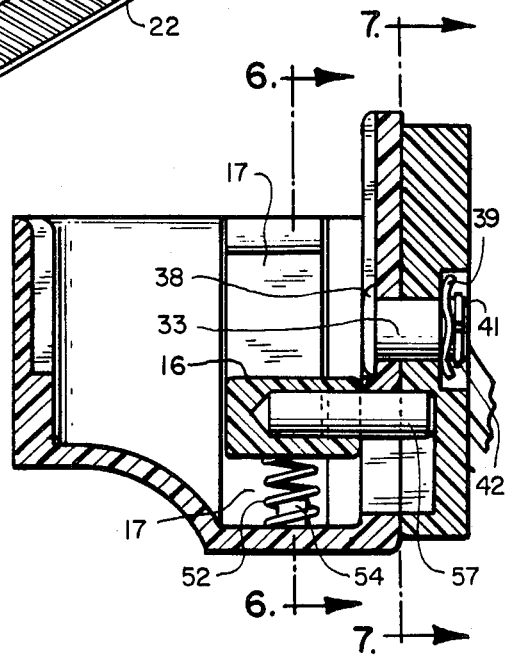
FIG. 6
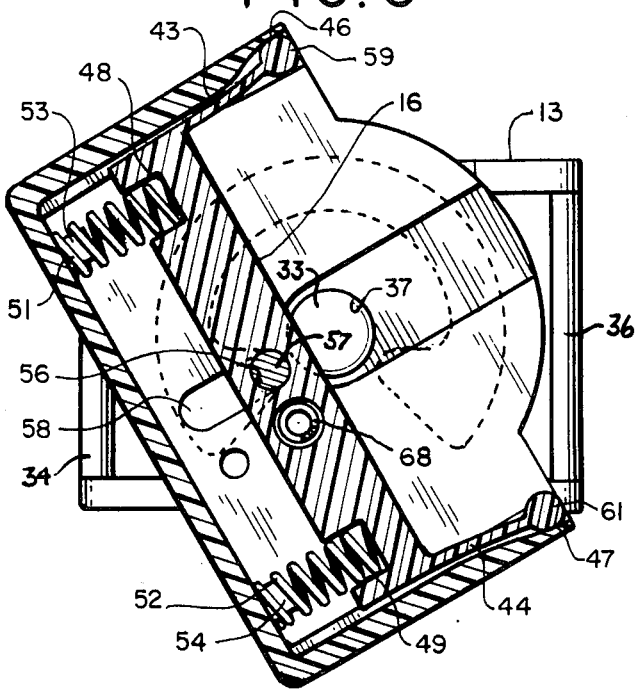
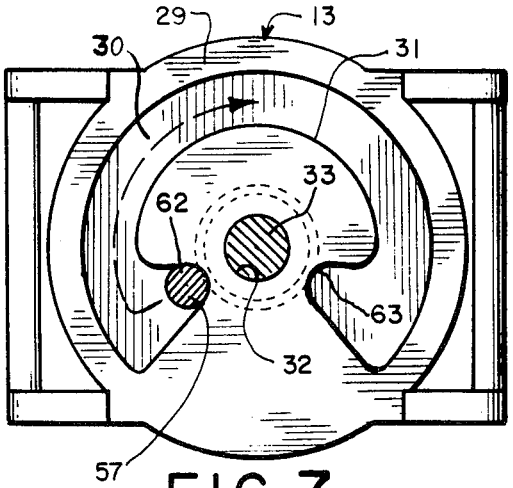
FIG. 7

FIG. 9
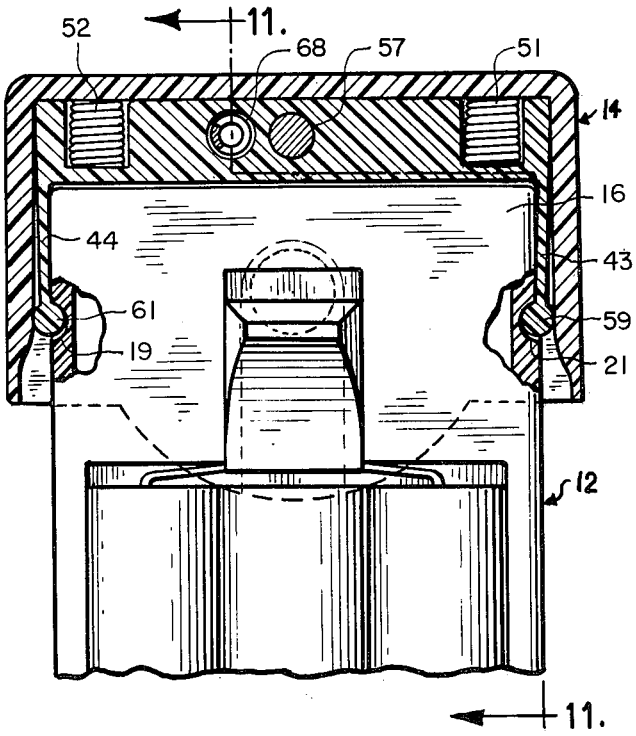
FIG. 8
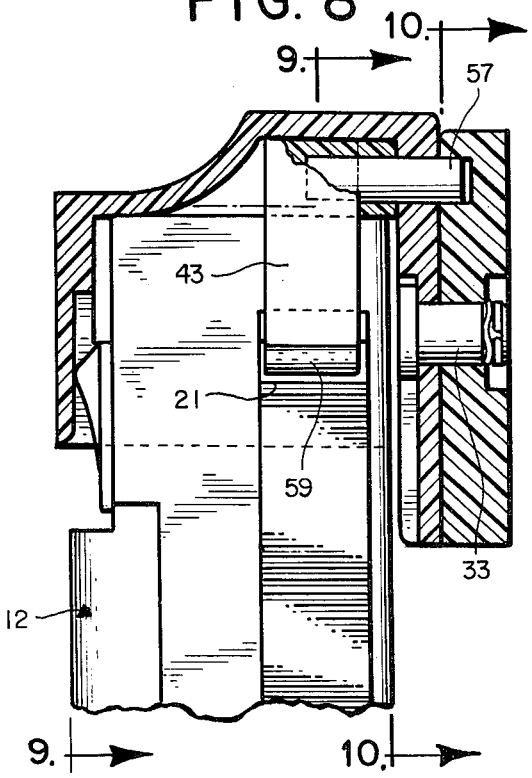
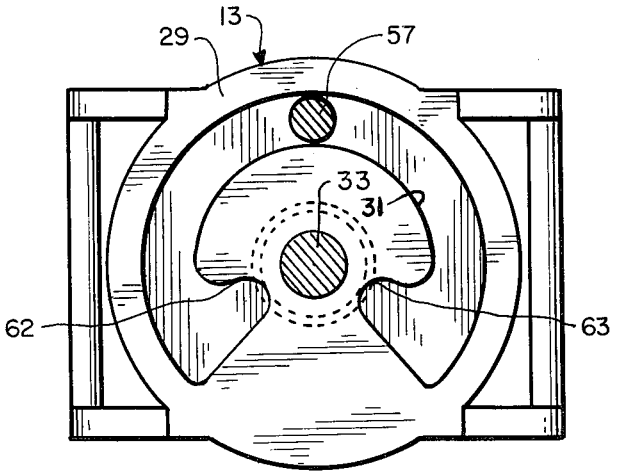
FIG. 10
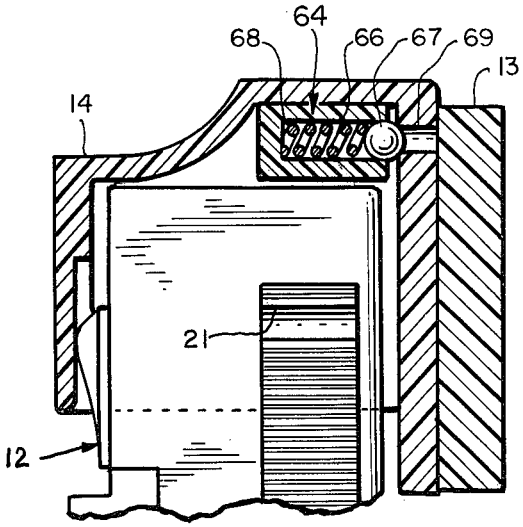
FIG. 11

BELT HOLDER FOR PORTABLE RADIO APPARATUS

BACKGROUND OF THE INVENTION

This invention relates generally to belt holders for portable radio apparatus, and more specifically to belt holders for portable radio apparatus wherein the apparatus is engaged by the holder during transit, and automatically disengaged by the holder upon being positioned for removal.

In recent years portable transceivers and similar battery operated radio apparatus have come into wide use for a wide variety of applications. Policemen, firemen and private security guards routinely carry such portable transceivers while performing their duties to satisfy a need for instant and reliable communication. In order to maximize the effectiveness of such communications it is desirable that portable transceivers be within easy reach, which necessitates the user carrying the transceiver with him while on duty. The usual practice has been to carry the transceiver in some form of belt holder so that the transceiver can be kept within easy reach.

The usual form of belt holder for portable transceivers consists of a leather pouch or holster attached to the belt of the user into which the radio is seated while not in use. A leather flap, fitted with some form of snap fastener, is typically used to secure the transceiver in the leather pouch. In order for the user to place a transceiver carried in such a pouch into use, it is necessary for him to disengage the snap fastener and then lift the transceiver from the leather pouch. If the pouch is particularly close fitting, the user may experience some difficulty in removing the transceiver. Consequently, the use of two hands is often required in order to insert or remove the radio when a conventional leather holster is used.

If the configuration of the pouch requires that the transceiver be carried in an upright position, the short antenna which typically extends from the top surface of the transceiver may often extend above the belt line of the wearer, interfering with his freedom of movement, and may result in discomfort during certain activities, such as driving or riding in an automobile. However, if the transceiver is attached to the wearer's belt in an inverted position, the entire transceiver unit, including the antenna portion, extends downward along the wearer's hip, resulting in greater freedom of movement and comfort to the wearer.

Portable transceivers may be expensive, and to drop a transceiver to the ground from belt height can result in damage to the unit. Consequently, a belt holder should hold a transceiver securely and positively, in order to avoid loss or damage to the unit.

Accordingly, it is an object of the present invention to provide a belt holder which allows ready access to a hand held portable transceiver while securely and safely holding the transceiver unit in transit, and which automatically releases the transceiver into the hand of the user when it is required for use.

It is a further object of the present invention to provide a belt holder for a portable transceiver which maintains the transceiver in an inverted position along the hip of the wearer.

Other objects and advantages of the present invention will become apparent as the description proceeds.

SUMMARY OF THE INVENTION

A belt holder for detachably affixing a portable apparatus to a wearer's belt includes a belt fastener secured to the belt, a receptacle housing pivotally attached to the belt fastener, and clamp means within the receptacle housing for detachably engaging the apparatus in the receptacle housing. Actuator means condition the clamp means from a clamped to an unclamped condition upon the receptacle housing being rotated relative to the belt fastener to allow removal of the apparatus from the receptacle.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 4 is an exploded perspective view of the belt holder and portable transceiver.

FIG. 5 is a cross-sectional view of the belt holder taken along line 5—5 of FIG. 4, showing the internal construction of the belt holder.

FIG. 6 is a cross-sectional view of the belt holder taken along line 6—6 of FIG. 5.

FIG. 7 is a cross-sectional view of the belt holder taken along line 7—7 of FIG. 5, showing the cam mechanism thereof.

FIG. 8 is a partial cross-sectional view of a portable transceiver installed within the belt holder.

FIG. 9 is a partial cross-sectional view of a transceiver installed in a belt holder taken along line 9—9 of FIG. 8.

FIG. 10 is a cross-sectional view taken along line 10—10 of FIG. 8 showing the cam mechanism in a clamped condition.

FIG. 11 is a partial cross-sectional view taken along line 11—11 of FIG. 9 showing the spring ball detent mechanism.

DESCRIPTION OF THE PREFERRED EMBODIMENT

Figure 1:
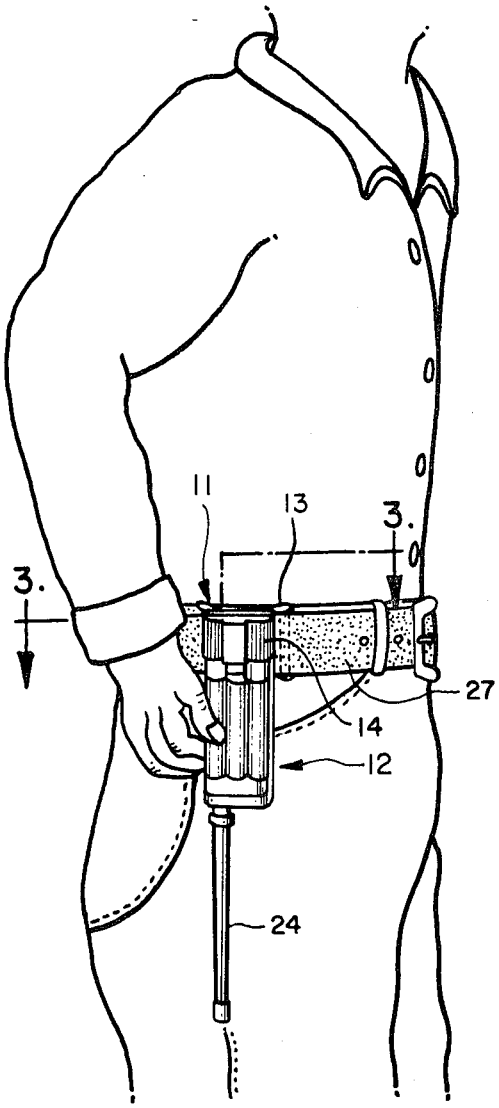
FIG. 1 is a side view of an individual wearing a belt holder constructed in accordance with the invention and containing a portable radio transceiver in a normal transit position.

Referring to the drawings, and particularly to FIGS. 1–4, a belt holder 11 constructed in accordance with the invention for use in carrying battery operated portable transceivers and other portable electronic equipment is shown in conjunction with a portable transceiver 12. Referring specifically to FIG. 4, the belt holder 11 is seen to comprise a belt fastener 13, a receptacle housing 14, and a clamp member 16. The clamp member is housed partially within a channel 17 in the receptacle housing 14, which is rotatably attached to the belt fastener 13 about a pivot 18. The receptacle housing 14 is dimensioned to receive the bottom portion of the portable transceiver 12. The transceiver housing includes a first recess 19 on the lower side portion of its housing, and a second clamp recess 21 on the lower side portion of its housing opposite recess 19, for engaging clamp member 16. In accordance with conventional practice, the transceiver may include pushbutton switches 22 and 23 for controlling the transmit and receive functions of the transceiver, and a flexible antenna 24.

Figure 2:
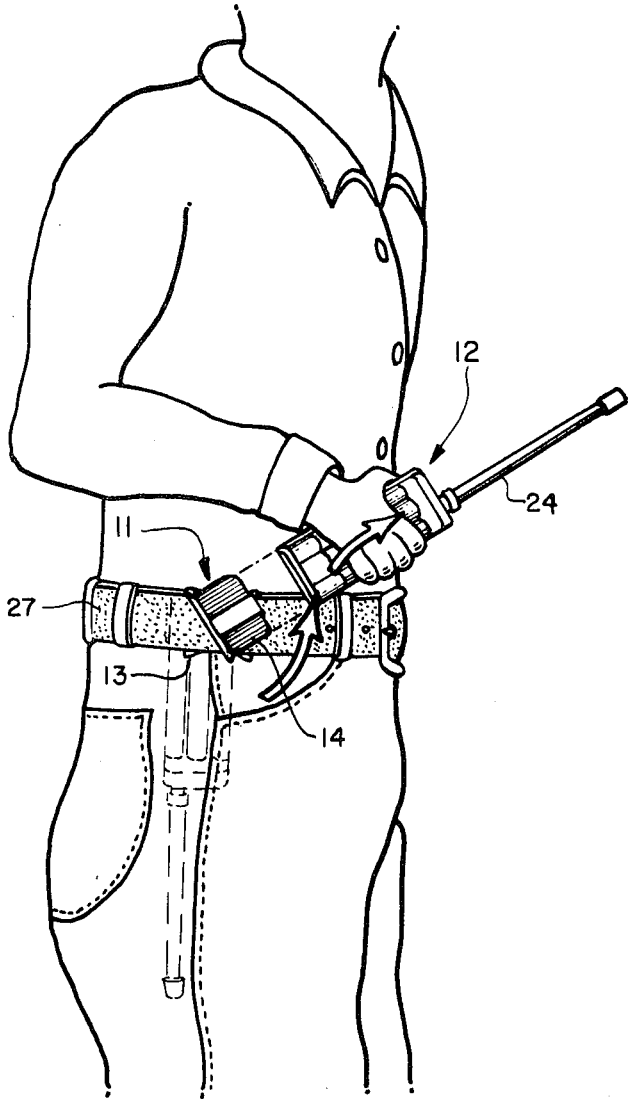
FIG. 2 is a side view of the individual and belt holder of FIG. 1 showing the transceiver being removed for use.
Figure 3:
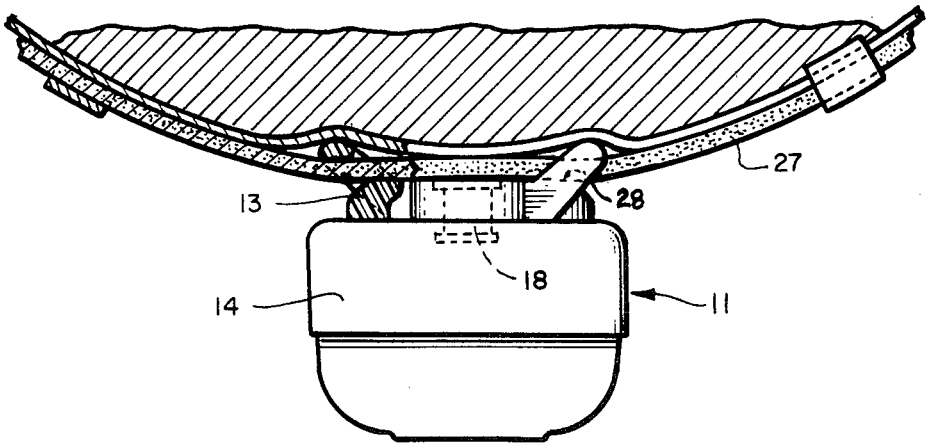
FIG. 3 is a partial cross-sectional view of the belt holder taken along line 3—3 of FIG. 1.

FIGS. 1, 2 and 3 show the manner in which the belt holder is used by a wearer to detachably carry a battery operated portable transceiver. The wearer's belt 27 is seen to pass through two apertures 28 integrally formed along the rear surface of the belt fastener.

FIG. 1 shows the belt holder 11 in place on the belt of the wearer and further shows a portable transceiver 12 securely clamped therein. The portable transceiver 12 is seen to be positioned along the hip of the wearer, and is further seen to be carried in an inverted position so that the flexible antenna extends downwardly.

FIG. 2 illustrates the position of the portable transceiver 12 in the normal wearing position, as shown by the broken line, and further shows the manner in which the portable transceiver is brought from the normal carrying position to the disengaged hand held condition. As illustrated, the wearer disengages the portable transceiver from the belt holder by grasping the body of the portable transceiver 12 and rotating it along with the receptacle housing 14 through approximately a 135° arc. After such rotation, the portable transceiver may be pulled from the belt holder. It should be noted that as the portable transceiver is grasped for rotation to the disengaged position, the wearer's fingers come naturally to the pushbutton switches 22 and 23 (FIG. 4) controlling the transmit and receive functions of the transceiver. Thus, the belt holder described herein allows the transceiver to be carried in the preferred antenna down position, and further allows the transceiver to be quickly and easily brought into the hand of the wearer in a position well suited for rapid operation of the transceiver. Also, only one hand is required to easily disengage the transceiver from the belt holder.

FIGS. 5–11 show in greater detail the construction and operation of belt holder 11. The belt fastener 13 is made from a rigid material such as hard plastic and is designed for rotational engagement with the receptacle housing 14. As shown in FIG. 7, the belt fastener includes a bearing surface 29 which engages a bearing surface on receptacle housing 14. The bearing surface 29 is seen to include a recess 30 which extends generally circumferentially about three-fourths the way around the surface of the belt fastener to form a camming surface 31. At either end of the recess 30 the width of the recess is increased toward the center of the belt fastener surface to form detent surfaces. A pivot aperture 32 is provided at the center of engaging surface 29 to receive a pivot shaft 33. The belt fastener is further seen to include wing portions 34 and 36 at either end, which together form the two apertures through which a belt may be passed in order to secure the belt holder assembly to the wearer's belt.

The receptacle housing 14 is designed for rotatable engagement with the engaging surface 29. As shown in FIG. 5, the pivot shaft 33, which may be formed of some suitably hard material such as steel, extends through an aperture 37 in the rear surface of the receptacle housing 14 and through the pivot aperture 28 of the belt fastener 13. A head 38 of relatively large diameter is formed at one end of the pivot shaft 33 to limit travel of the pivot shaft through the pivot aperture. A spring clamp 39, placed over the smaller diameter end of the pivot shaft, is held in place by a retaining ring 41 received in a groove 42 at the extreme end of the pivot shaft. The retaining ring provides a bearing surface, so that the spring clamp 39 can provide tension on the pivot shaft 33 sufficient to hold the receptacle housing firmly against the belt fastener 13 while allowing rotation of the receptacle housing with respect to the belt fastener.

The clamp member 16, which may be formed of partially flexible material such as plastic, is positioned along the rear wall of the receptacle housing. The clamp member is generally rectangular in section and is dimensioned so as to be slidably received by channel 17 within the housing. The clamp member is provided with two clamp arms 43 and 44. In the illustrated embodiment the clamp arms are integrally formed as part of the clamp member and thus are made of the same material used in the clamp member. However, the clamp arms may be formed of metal and are then attached to the body of the clamp member. Each clamp arm is biased outwardly from the clamp body so that it slidably engages respective adjacent walls 46 and 47 of channel 17. The clamp arms are each provided with a protrusion along their upper edge, which extends away from the wall of the receptacle housing. These protrusions are dimensioned so as to engage the recesses 19 and 21 provided in the transceiver housing. The channel walls 46 and 47, against which the outwardly biased clamp arms 43 and 44 bear, include ramp portions, as illustrated in FIGS. 6 and 9, whereby the upper portion of the channel provided in the receptacle housing is tapered toward the bottom interior surface of the receptacle housing.

FIG. 6 shows the clamp member 16 mounted for reciprocation within within the receptacle housing 14. The under surface of the clamp member is provided with two recesses 48 and 49 dimensioned to each receive an end of respective ones of two helical springs 51 and 52 disposed between the clamp body and the bottom interior surface of the receptacle housing. The opposite ends of springs 51 and 52 are engaged by cylindrical protrusions 53 and 54, respectively, which extend upward from the bottom interior surface.

The rear surface of the clamp member immediately adjacent the interior longitudinal wall of the receptacle housing is provided with a recess 56 equi-distant from the longitudinal ends of the clamp body. A cam follower 57, which may be manufactured from a rigid and hard material such as polished steel, is fixedly mounted in recess 56, and extends through a generally vertical slot-shaped aperture 58 provided in the rear surface of the receptacle housing.

In operation, when the clamp member 16 is displaced toward the bottom interior surface of the receptacle housing against the compressive force of coil bias springs 51 and 52 cam follower 57 moves along the slot shaped aperture 58 and clamp arms 43 and 44 are displaced toward one another by reason of the ramped surfaces 46 and 47 against which they bear.

FIGS. 8 and 9 show a portable transceiver held firmly in place by a belt holder of the type disclosed herein. The clamp member has been displaced to the extent of its travel in the direction toward the bottom interior surface of the receptacle housing. Clamp arms 43 and 44 have been displaced toward one another by the ramped surfaces 46 and 47. The protrusions 59 and 61 provided along the upper edges of clamp arms 43 and 44 are received in recesses 21 and 19 provided in the exterior surface of the portable transceiver 12. Consequently, the transceiver is held firmly in the inverted vertical position shown in FIG. 9.

The movement of the clamp member toward the bottom surface of the receptacle housing is provided by actuator means in the form of cam follower 57 and cam surface 31. The cam follower 57 extends through the slot shaped aperture 58 provided in the rear wall of the receptacle housing, and into the recess 30 provided in the engaging surface 29 of belt fastener 13. Springs 51 and 52 cause cam follower 57 to bear against the cam surface 31 provided in the belt fastener 13. As the receptacle housing 14 is rotated about pivot shaft 33 in the direction shown in FIG. 7, cam surface 31 displaces cam follower 57 radially away from the axis of pivot shaft 33 with the effect that the cam follower, along with the clamp member to which it is fixedly attached, is driven downward with respect to the receptacle housing, resulting in actuation of the clamp arms 43 and 44. The rotational travel of the receptacle housing with respect to the belt fastener is limited to approximately 270° by cam surface 31.

When the receptacle housing is in the clamped position illustrated in FIGS. 1 and 9, the position of the cam follower 57, relative to the cam surface 31 is shown in FIG. 10. In this position the cam surface 31 prevents the cam follower 57 from traveling in a radial direction toward the central axis of the pivot shaft 33. Consequently, the clamp member 16, to which the cam follower 57 is attached, is prevented from moving away from the bottom of the receptacle hosuing and the transceivers is locked securely in place.

However, when the receptacle housing is in the position indicated in FIGS. 2 and 6, the cam follower 57 and cam surface 31 are as illustrated in FIG. 7. In this position, the cam follower 57 is free to move in a radial direction toward the central axis of the pivot shaft by reason of lobes 62 and 63 in cam surface 31, thereby allowing the clamp member 16 to move away from the bottom of the receptacle housing. The cam follower 57 is also free to move in a radial direction when the receptacle housing is rotated 270° clockwise from the position shown in FIG. 6. Thus, the belt holder is provided with two release positions, separated by a 270° rotation of the receptacle housing.

As shown in FIG. 6 clamp member 16 is also provided with a spring-loaded ball bearing detent mechanism 64 on its rear surface adjacent cam follower 57. As shown in FIG. 11, the detent mechanism 64 includes within a detent recess 66 in the rear surface of the clamp member a spherical detent ball 67 of steel or other suitable hard material dimensioned so as to be slidably received within the recess, and a coil detent spring 68, which biases the ball outward from the detent recess 66, and against the adjacent interior wall of the receptacle housing. A circular aperture 69 is provided thorugh the wall of the receptacle housing so that when the clamp body is in the clamped position shown in FIG. 9, the spherical detent ball 67 is received in the circular aperture 69 so as to retain the clamp member in the clamped position. While the cam follower 67 in conjunction with the cam surface 31 is intended to block any movement of the clamp body when the receptacle housing is not in either of the two positions for allowing release of the portable transceiver, the purpose of the detent mechanism 64 is not to prevent such movement, but rather to provide a positive clock stop for the clamp mechanism. When the receptacle housing is rotated to either of the two release positions, the detent mechanism provides sufficient holding force so that the transceiver contained in the belt holder will not disengage until the wearer grasps the transceiver and pulls it in an outward direction with a force sufficient to overcome the holding force provided by the detent mechanism. This is a safety feature to retain the transceiver in the holder should the transceiver be inadvertently rotated to a release position.

As has been noted earlier, the belt holder 11 is provided with two positions in which it is possible to disengage a portable transceiver clamped therein. Because of this, the belt holder is suitable for use on either the right or the left hand side of the wearer depending on which hand it is more convenient for him to use in bringing the transceiver into operation. Whether on the right or left side, the wearer need only rotate the transceiver forward and then pull it outward in order to release the portable transceiver from the belt holder.

When replacing the portable transceiver in the belt holder, the wearer simply places the base portion on the portable transceiver into the receptacle housing, and then rotates both the portable transceiver and the receptacle housing downward toward the normal carrying position illustrated in FIG. 1. As the transceiver and receptacle housing are rotated downward, the cam mechanism, in the manner previously described, forces the clamp body to the clamped position shown in FIG. 9, resulting in the portable transceiver being held firmly within the belt holder.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A belt holder for detachably affixing a portable apparatus to a wearer's belt comprising:
   - a belt fastener secured to the belt;
   - a receptacle housing pivotally attached to said belt fastener;
   - clamp means within said receptacle housing for detachably engaging the apparatus in said receptacle housing; and
   - actuator means for conditioning said clamp means from a clamped to an unclamped condition upon said receptacle housing being rotated relative to said belt fastener to allow removal of the apparatus from said receptacle.

2. A belt holder as defined in claim 1 wherein said clamp means include a clamp member having projecting clamp arms displaceable toward and away from one another.

3. A belt holder as defined in claim 2 wherein the clamp member includes two clamp arms disposed on either side of the clamp member.

4. A belt holder as defined in claim 3 wherein each clamp arm includes a protrusion along its upper edge for engaging a complementary shaped groove in the unit to be clamped.

5. A belt holder as defined in claim 4 wherein said receptacle housing includes a channel within which a clamp member may be mounted for reciprocation.

6. A belt holder as defined in claim 5 wherein the clamp member is mounted for reciprocation within said receptacle housing.

7. A belt holder as defined in claim 6 wherein said channel is dimensioned so as to slidably engage said clamp arms.

8. A belt holder as defined in claim 7 wherein said channel is tapered so as to displace said clamp arms toward or away from one another as said clamp member reciprocates within said channel.

9. A belt holder for detachably affixing a portable apparatus to a wearer's belt, comprising:

a belt fastener secured to the belt;

a receptacle housing pivotally attached to said belt fastener;

clamp means within said receptacle housing including a clamp member having two projecting clamp arms displaceable toward and away from one another disposed on either side of the clamp member; and actuator means for conditioning said clamp means from a clamped to an unclamped condition upon said receptacle housing being rotated relative to said belt fastener to allow removal of the apparatus from said receptacle.

10. A belt holder as defined in claim 9 wherein said clamp arm includes a protrusion along its upper edge for engaging a complementary shaped groove in the unit to be clamped.

11. A belt holder as defined in claim 10 wherein said receptacle housing includes a channel within which a clamp body may be mounted for reciprocation.

12. A belt holder as defined in claim 11 wherein the clamp member is mounted for reciprocation within said receptacle housing.

13. A belt holder as defined in claim 12 wherein said channel is dimensioned so as to slidably engage said clamp arms.

14. A belt holder as defined in claim 13 wherein said channel is tapered so as to displace said clamp arms toward or away from one another as said clamp body reciprocates within said channel.

* * * * *